United States Patent [19]

Schreves

[11] 4,003,592

[45] Jan. 18, 1977

[54] MACRAME ASSEMBLY HOLDER

[76] Inventor: Dave W. Schreves, 2145 Emerald, NE., Grand Rapids, Mich. 49505

[22] Filed: Feb. 17, 1976

[21] Appl. No.: 658,294

[52] U.S. Cl. ..... 289/18; 248/176

[51] Int. Cl.[2] ..... B65H 69/04

[58] Field of Search ..... 289/1.2, 1.5, 17, 18; 28/15; 87/33; 248/176; 294/67

[56] References Cited

UNITED STATES PATENTS

| | | | |
|---|---|---|---|
| 2,202,924 | 6/1940 | Rosen | 28/15 |
| 2,395,981 | 3/1946 | Walker | 28/15 |
| 2,712,769 | 7/1955 | Prescott | 87/33 |
| 2,800,949 | 7/1957 | Horowitz | 248/176 |

*Primary Examiner*—Louis K. Rimrodt
*Attorney, Agent, or Firm*—McGarry & Waters

[57] ABSTRACT

A self-supporting macrame assembly holder for hanging macrame at a variety of adjustable vertical positions while it is being completed comprises a frame that is sufficiently high to permit a person to sit on a chair under the frame and a line and pulley suspension mechanism for hanging the macrame from the frame. The frame includes a crown including a front section and a transverse section extending perpendicularly from the front section. Two front legs of the frame are pivotally mounted to the front section and a rear leg is pivotally mounted to the transverse section. The front legs are extendible in telescopic fashion, and the rear leg includes an L-joint which permits an upper portion of the leg to be placed in a variety of angular positions with respect to the lower portion of the leg. Macrame is suspended from one end of the line; the other end of the line can be attached to the frame in a variety of positions along the chain in order to raise and lower the macrame with respect to the frame.

10 Claims, 4 Drawing Figures

MACRAME ASSEMBLY HOLDER

BACKGROUND OF THE INVENTION

1. Field of the Invention

This invention relates to a self-supporting stand for holding or suspending macrame at any desired vertical position while it is being made.

2. State of the Prior Art

Over the past few years, the art of making macrame has become an increasingly popular hobby. In order to make macrame, it is necessary to suspend the macrame from some suitable object or to lay the macrame flat on a table. Suspension of macrame is preferable, because macrame is made generally by tying knots in hanging lines and gradually working downwardly as the macrame is completed.

In order to suspend a macrame project while it is being completed, numerous objects have been used, such as door knobs, lamp fixtures, chair arms, the tops of doors, and the like. Moreover, the position of the macrame assembly has to be shifted repeatedly as the macrame becomes longer. This frequently forces the person making the macrame to sit or otherwise occupy an awkward position while working on his macrame project. This produces fatigue and detracts from the enjoyment that might otherwise be gained from making macrame.

It is a primary object of the present invention to provide a simple and easily adjustable holder for a macrame assembly that permits a person to make macrame while sitting in a chair or other convenient working location and work on the macrame at a single, comfortable working position.

SUMMARY OF THE INVENTION

In accordance with the present invention, a macrame assembly holder for hanging a macrame assembly in a variety of adjustable vertical positions comprises a frame including a plurality of upwardly extending legs that are interconnected at upper portions thereof, and a suspension mechanism for hanging the macrame assembly from the frame. The frame is sufficiently high to permit a person to sit under the frame, and the suspension mechanism is adjustable to vary the vertical position of the macrame assembly with respect to the frame.

The frame includes a crown member at the top thereof interconnecting the legs. The legs are attached to the crown member by adjustable fastening means which hold the legs in a fixed position with respect to the crown when the fastening means are tightened and which permit pivotal movement of the legs with respect to the crown when the fastening means are loosened.

The frame of the present invention includes three legs, two front legs and a rear leg. The front legs are telescoping to permit variation in frame height and to facilitate shipping and storage of the apparatus. The rear leg has an L-joint in the middle of it to permit the variation in the angular disposition of the upper and lower portions of the rear leg. This facilitates positioning the frame when it is necessary to place the rear leg of the frame behind a chair or sofa that is positioned near a wall.

Desirably, the crown includes a front section extending across the front of the frame and a transverse section extending perpendicularly from the front section. The rear leg is pivotally attached to the transverse section and the front legs are attached to the front section on opposite sides of the transverse section. Each leg is attached to the crown for pivotal movement about an axis perpendicular to the section of the crown to which it is attached.

The suspension mechanism for suspending the macrame assembly from the frame comprises a pulley and line mechanism, with the pulley being suspended from the crown and the line passing through the pulley. One end of the line includes a hook for hanging the macrame assembly from the line, while the other end of the line is attachable to the frame in order to hold the line in a fixed position. Preferably, the type of line used is a small link chain, and the chain is fixed into position on the frame by means of a projection extending from the frame which can fit through any of the apertures in the links in the chain.

The macrame assembly holder is formed to be as high as possible in order to permit maximum height variation in the macrame assembly, but it must be low enough to permit the macrame assembly holder to be used in an ordinary room. Desirably, the legsare about 8 feet long when fully extended. The size of the crown, with the transverse section being about seven inches long, makes it easier to sit under the stand and have a macrame assembly suspended in front of the person working on the macrame. The widely adjustable leg positions permit maximum variation in frame position to accomodate different types of furniture and working positions.

These and other advantages and features of the present invention will hereinafter appear, and, for purposes of illustration, but not of limitation, a preferred embodiment of the present invention is described in detail below and shown in the appended drawings.

DETAILED DESCRIPTION OF THE PREFERRED EMBODIMENT

Figure 1:
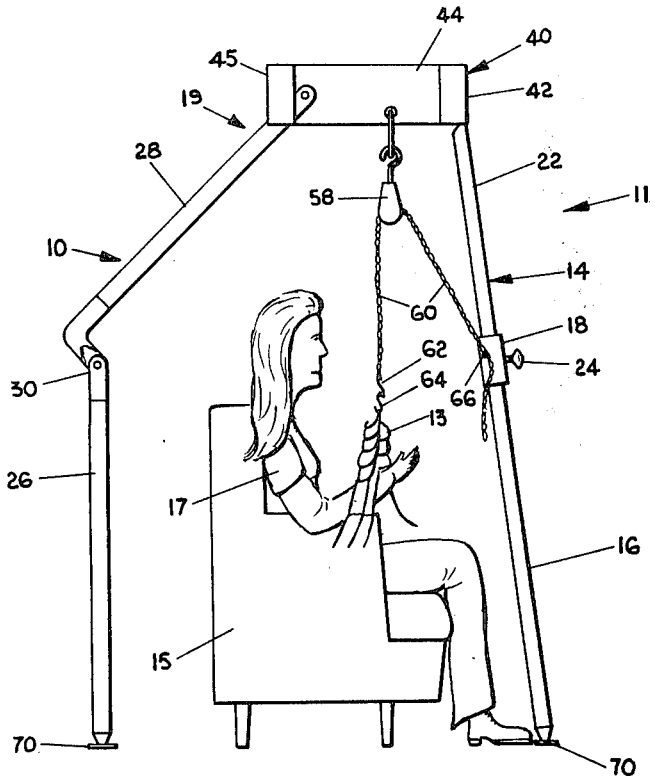
FIG. 1 is a perspective view showing the manner in which the macrame assembly holder of the present invention is employed in making macrame.

Referring now to the drawings, FIG. 1 discloses a macrame assembly holder 11 constructed in accordance with the present invention in an operative position. Macrame assembly holder 11 is shown supporting a macrame assembly 13 over a chair 15 in which person 17 is sitting while working on the macrame. Although any convenient working station or position can be used with the macrame assembly holder of the present invention, a chair is shown herein for illustrative purposes.

Macrame holder 11 comprises a self-supporting frame 19 and a pulley and chain mechanism attached to the frame for adjustably suspending the macrame assembly from the frame.

Frame 19 is a tripod stand comprising a crown 40 attached to and interconnecting the tops of three legs, a front left leg 12, a front right leg 14, and a rear leg 10. Crown 40 is made from light weight metal, such as aluminum, and has an I-shaped cross section comprising a front section 42, a transverse section 44 extending rearwardly from the center of the front section 42 and a rear section 45 attached to the rear of the transverse section. Front legs 12 and 14 are pivotally attached to front section 42. Rear leg 10 is pivotally attached to the transverse section 44.

Preferably, the front legs 12 and 14 are telescopic to enable any convenient adjustments in length. The rear leg 10 preferably has an L-joint to enable the lower section 26 of the rear leg to extend vertically downwardly to enable it to be placed in tight spots, for example, between the back of a chair and wall a few inches behind the back of the chair. The L-joint in the rear leg and telescoping front legs also allow the entire unit to be collapsed for shipping or storage.

Figure 4:
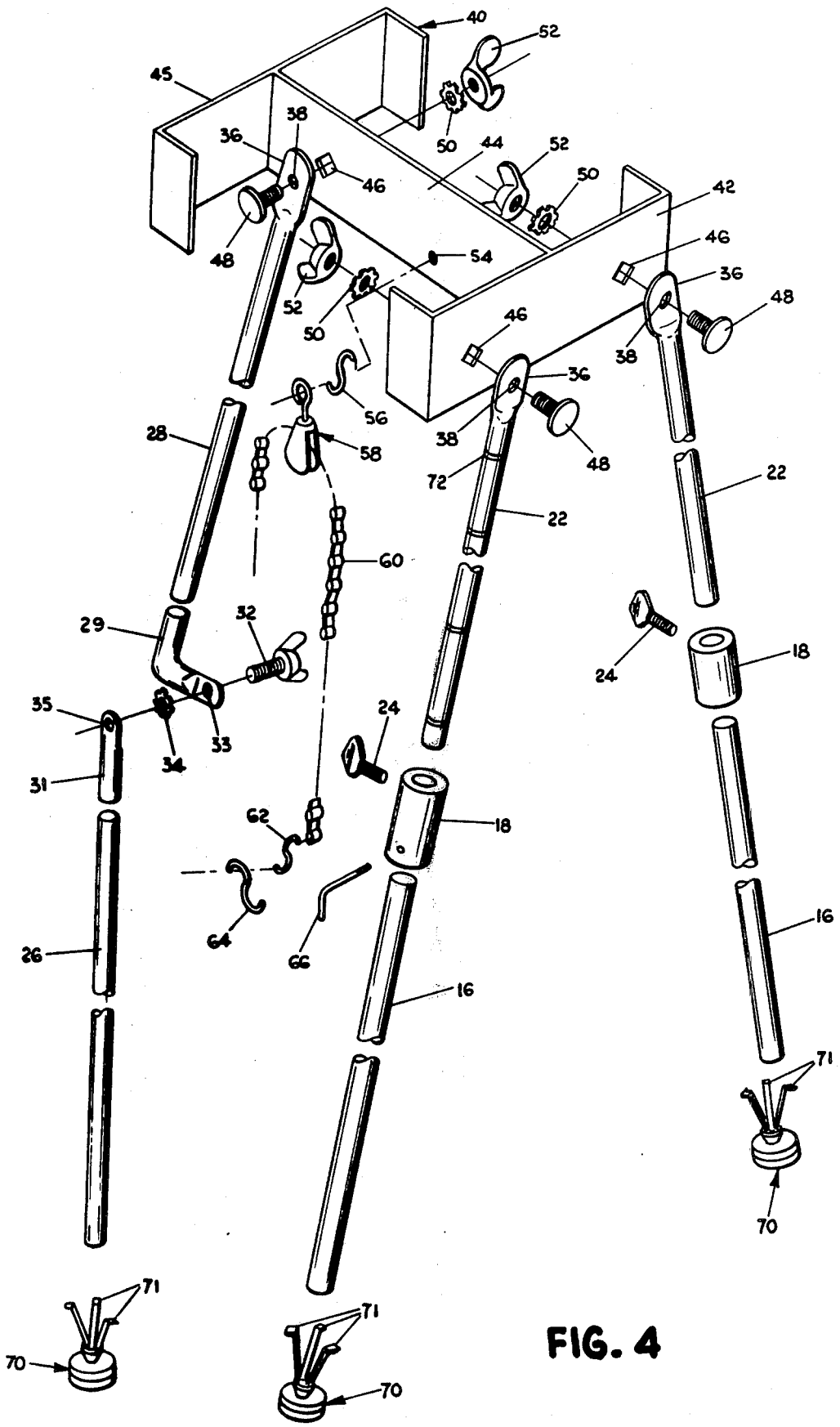
FIG. 4 is an exploded perspective view of the present invention.

In FIG. 4, which discloses an exploded view of the macrame assembly holder, means by which the crown is attached to legs 10, 12, and 14 can be seen. Crown 40 has square apertures 46 therethrough, two apertures on the front section 42 and one on the transverse section 44. Each leg has a flattened top section 36 having an aperture 38 therethrough which is aligned with one of the square apertures in the crown. A bolt 48 extends through each aperture 38 and corresponding aperture 46 in the crown, with a star washer 50 being positioned between the apertures. A wing nut 52 is threaded on the threaded end of each bolt 48 to secure the legs 10, 12, and 14 in a plurality of movable positions. A collar extending inwardly from the head of each bolt tightly engages the square aperture and non-rotatably holds the bolt in the aperture. Readjustment of the positions of the legs requires only a loosening and retightening of the wing nut 52 on each bolt 48. The front legs 12 and 14 are pivotally adjustable in a sideways direction, while the rear leg 10 is pivotally adjustable in a forward and backward direction perpendicular to the adjustable direction of the front legs 12 and 14. Front legs 12 and 14 are identical and are each fabricated from an upper tubular section 22, a lower tubular section 16, a collar 18, and set screw 24. Upper tubular section 22 fits inside lower tubular section 16. Collar 18 is attached to the lower section 16 of each leg. Collar 18 is tubular and allows the upper section 22 to extend through and slide within the lower tubular section 16. A thumb set screw 24 threadably extends through a threaded opening in the side of collar 18 and releasably clamps upper section 22 in any fixed position with respect to the lower section 16. Front legs 12 and 14 may have their lengths adjusted by the thumb set screw 24 being loosened, the upper section moved to a new position, and the thumb screw 24 retightened.

Rear leg 10 has an upper tubular section 28 and a lower tubular section 26. An aluminum rod 31 fits snugly within and extends upwardly from the lower section 26. Aluminum rod 31 has a flattened surface on the upper end with a threaded aperture 35 therethrough. Another aluminum rod 29 fits snugly within and extends downwardly from the bottom of upper section 28. Rod 29 has a right angle bend therein such that a portion of the rod extends forwardly. A flattened surface is formed on the end of rod 29 with an aperture 33 being formed therethrough. A wing bolt 32 extends through apertures 33 and 35, with a star washer 34 fitting between the apertures to insure secure fit between rods 29 and 31. Wing bolt 32 engages the threaded aperture 35 to secure the upper section 26 and lower section 26 in any desired relative angular position. Casters 70 are attached to the bottom of the legs 10, 12, and 14 by means of prongs 71 on the casters which fit into the interior of the tubular legs.

Figure 3:
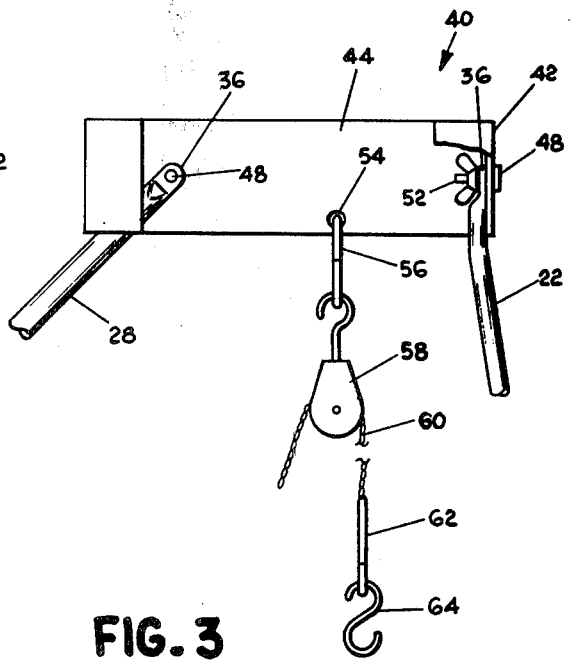
FIG. 3 is a fragmentary side-elevational view of the top section of the invention.

As shown in FIG. 3, a pulley 58 is mounted from crown 40. A flexible suspension member in the form of a linked chain 60 fits through the pulley. A rope or line or other such suspension member also could be used. For definition purposes, the term "line" will be used herein to define any type of flexible suspension member that will satisfy this purpose. A small S-hook 62 fits into the bottom link of the chain, and a larger S-hook 64 for suspending macrame is suspended from small S-hook 62. The pulley 58 is suspended from the crown by means of another small S-hook 56 which extends through an aperture 54 in the transverse section 44 of the crown toward the front section 42 of the crown 40. The chain 60 is held in a fixed position in the apparatus by means of a right angle hook 66 which is threaded into collar 20. The level of the macrame hook 64 can be adjusted by releasing chain 60 from the right angle hook 66 and reattaching the chain to the right angle hook 66 through a different link in the chain. The length of chain 60 to be moved can be measured by "spaced" markings 72 which are visible on the upper section 22 of the right front leg 12.

Figure 2:
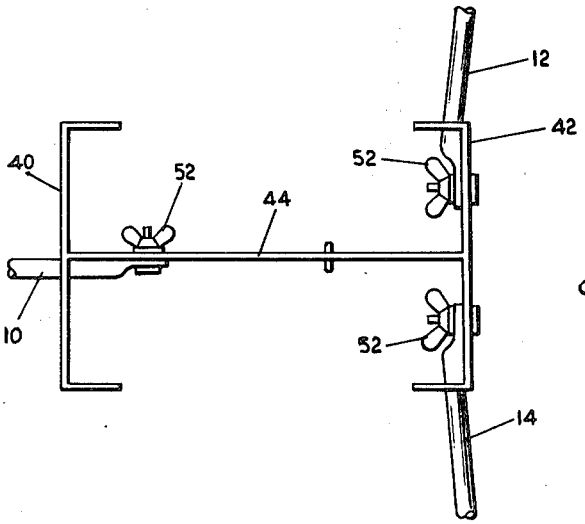
FIG. 2 is a fragmentary plan view of the top of the macrame assembly holder of the present invention.

FIG. 2 discloses the plan view of the macrame assembly holder and the spaced relationship of the legs 10, 12, and 14. Enough room exists between the front legs 10 and 12 and the rear leg 10 to allow a chair to be placed underneath the macrame assembly holder. The macrame assembly holder can also be placed over a sofa since the present invention presents no obstructions on the right or left side where a sofa would extend outward.

The elongated crown also plays an important function in the operation of the apparatus. The relatively long transverse section of the crown makes it easy for the macrame assembly to be positioned in front of the person making the macrame, instead of being positioned directly above the person. The front section positions the legs outwardly away from a position directly in front of the person making the macrame. This makes it easier to work on the macrame and makes it easier to step under the frame in order to sit in the chair. Desirably, the front section of the crown is about 5 ½ inches long and the transverse section is about 7 inches long.

In using the present invention, a person first selects a convenient working station, such as a chair or a sofa, and erects the macrame assembly holder over that location. A macrame assembly is then suspended from the macrame hook, and the chain position is adjusted to provide a convenient working height. As the macrame is completed and becomes larger, the chain position is adjusted to move the macrame assembly upwardly. Thus, the macrame work can continue at the same convenient working height regardless of the length of the macrame.

It should be understood that the foregoing embodiment of the present invention is merely illustrative of the preferred practice of the present invention and that various changes and modifications may be made in the arrangements and details of construction of the embodiments described herein without departing from the spirit and scope of the present invention.

The embodiment of the invention in which an exclusive property or privilege is claimed as follows:

1. A macrame assembly holder for hanging a macrame assembly at a variety of adjustable vertical positions while a person works on the macrame, said macrame assembly holder comprising:

a frame including a plurality of upwardly extending legs that are interconnected at upper portions thereof, the frame being sufficiently high to permit a person to sit under the frame; and suspension means for hanging the macrame assembly from the frame, said suspension means being adjustable to vary the vertical position of the macrame assembly with respect to the frame.

2. A macrame assembly holder according to claim 1 wherein the frame includes a crown member at the top thereof interconnecting the legs, the legs being attached to said crown member by adjustable fastening means, said fastening means holding the legs in a fixed position with respect to the crown member when tightened and being releasable to permit pivotal movement of the legs with respect to the crown member in order to vary the positions of the legs.

3. A macrame assembly holder according to claim 2 wherein the frame includes three legs, and the crown member includes a front section extending across the front of the frame and a transverse section extending perpendicularly from the front section in a rearward direction at a position between the ends of said front section, one leg being attached to the transverse section and the other two legs being attached to the front section on opposite sides of the transverse section, each leg being attached to the crown member for pivotal movement about an axis perpendicular to the section of the crown to which the leg is attached.

4. A macrame assembly according to claim 3 wherein the legs attached to the front section are front legs and are extendible in telescoping fashion, and the leg attached to the transverse section is a rear leg and includes a pivotal joint between the ends thereof, the joint permitting variation in the relative angular positions of portions of the rear leg above and below the joint, the joint being capable of being tightened to lock the portions of the leg in a fixed angular position.

5. A macrame assembly holder according to claim 4 wherein the legs are about 8 feet long when fully extended and opened and the transverse section of the crown is at least about 7 inches long, the legs being collapsible and foldable to at least about one-half of their fully extended and opened length.

6. A macrame assembly holder according to claim 1 wherein the suspension means comprises a line and pulley mechanism, the pully being suspended from the top of the frame and the line passing through the pulley, the macrame assembly being releasably attached to one end of the line, the line on the other side of the pulley from said one end being releasably attachable to the frame, the vertical position of the macrame assembly being varied by adjustment in the position of the line through the pulley.

7. A macrame assembly holder according to claim 6 wherein the line comprises a linked chain, the chain being attachable to the frame by means of a projection extending from the frame that is engagable with the chain, one end of the chain having a hook means attached thereto for engaging and suspending the macrame.

8. A macrame assembly holder according to claim 7 wherein the frame includes three legs, two front legs and a back leg, the front legs being tubular and being extendible in telescoping fashion to vary the length of the legs, the rear leg comprising upper and lower sections with a releasable joint positioned between the ends, the joint permitting the upper and lower sections of the rear leg to be placed at a variety of fixed angular positions relative to one another, all three legs being interconnected by releasable fastening means that hold the tops of the legs in fixed relative positions when tightened and permit relative pivotal movement of the legs when loosened.

9. A macrame assembly holder as described in claim 8 wherein the front legs include:

an upper section and a lower section, the lower section being hollow and capable of receiving the upper section therein;

a collar mounted on the top of the lower section, the collar allowing the upper section to slide through it into the lower section, a threaded aperture being formed in the side of the collar opposite the upper section of the leg; and set screw means threaded into the threaded aperture of the collar for securing the upper section in a fixed position with respect to the lower section.

10. A macrame assembly holder comprising:

a crown having a front section and a transverse section extending perpendicularly therefrom at a point between the ends of the front section, the crown having an aperture formed in the front section on each side of the transverse section and an aperture formed in the transverse section;

two front legs pivotally attached to the front section of the crown on each side of the transverse section, each leg comprising:

a tubular upper section having a flattened section at the top with an aperture therethrough;

a tubular lower section capable of receiving the upper section in its interior;

a collar mounted on the top end of the lower section and having an opening therein aligned with the open interior of the lower section, said opening being sufficiently large to permit the upper section to slide downwardly through the collar into the lower section, said collar further having a threaded aperture in its side adjacent the upper section of the leg;

set screw means threaded into the aperture in the side of the collar for releasably holding the upper section in a fixed position with respect to the lower section; and a caster attached to the bottom end of the lower section of each leg;

a rear leg pivotally attached to the transverse section of the crown comprising:

a tubular upper section having a flattened section at the top with an aperture therethrough;

a rod rigidly positioned within and extending out of the lower end of the upper section having a right angle bend extending in the direction of the transverse section, said rod having a flattened section at its outer end with an aperture formed therethrough;

a lower tubular section;

a straight rod rigidly positioned within and extending out of the top end of the lower tubular section, the straight rod having a flattened top section with an aperture therethrough;

a removable fastener fitting through the apertures of the two rods, a star washer being disposed between the two rods so as to form a nonrotatable joint when the fastener is tightened, thus enabling the leg to be fixed in a plurality of bent positions; and a caster attached to the bottom of the lower section;

removable fasteners extending through apertures in the crown and apertures in the flattened top section of each leg, one fastener securing the rear leg to the transverse section of the crown such that the leg is adjustable in a forwardrearward direction and the other fasteners securing the front legs to the front section of the crown such that the front legs are adjustable in a sideways direction;

a pulley suspended from a forward portion of the transverse section of the crown;

a linked chain operatively engaged through the pulley;

hook means attached to an end of the chain for hanging macrame;

right angle hook means attached to one of the collars for engaging any desired link of the chain and securing the chain in any desired position; and spaced markings on the leg on which the right angle hook means is mounted, said spaced markings permitting measurement of lengths of chain to be adjusted for producing macrame of a given length.

* * * * *